US005758733A

United States Patent [19]

Scott et al.

[11] Patent Number: 5,758,733

[45] Date of Patent: Jun. 2, 1998

[54] EARTH-BORING BIT WITH SUPER-HARD CUTTING ELEMENTS

[75] Inventors: Danny E. Scott, Montgomery; Rudolf Carl Otto Pessier, Houston, both of Tex.; Robert J. Farr, Orem, Utah; Stephen R. Jurewicz, South Jordan, Utah; Kenneth M. Jensen; Paul D. Jones, both of Orem, Utah

[73] Assignee: Baker Hughes Incorporated, Houston, Tex.

[21] Appl. No.: 633,983

[22] Filed: Apr. 17, 1996

[51] Int. Cl.[6] ..... E21B 10/46

[52] U.S. Cl. ..... 175/432; 175/434

[58] Field of Search ..... 175/374, 426, 175/432, 434

[56] References Cited

U.S. PATENT DOCUMENTS

| | | | |
|---|---|---|---|
| 4,109,737 | 8/1978 | Bovenkerk | 175/329 |
| 4,148,368 | 4/1979 | Evans | 175/329 |
| 4,255,165 | 3/1981 | Dennis et al. | 51/309 |
| 4,694,918 | 9/1987 | Hall | 175/329 |
| 5,007,207 | 4/1991 | Phaal | 51/204 |
| 5,120,327 | 6/1992 | Dennis | 51/293 |
| 5,154,245 | 10/1992 | Waldenstrom et al. | 175/420 |
| 5,217,081 | 6/1993 | Waldenstrom et al. | 175/420 |
| 5,282,512 | 2/1994 | Besson et al. | 175/374 |
| 5,304,342 | 4/1994 | Hall, Jr. et al. | 419/11 |
| 5,335,738 | 8/1994 | Waldenstrom et al. | 175/420 |
| 5,351,772 | 10/1994 | Smith | 175/428 |
| 5,355,969 | 10/1994 | Hardy et al. | 175/432 |
| 5,379,854 | 1/1995 | Dennis | 175/434 |
| 5,437,343 | 8/1995 | Cooley et al. | 175/431 |
| 5,469,927 | 11/1995 | Griffin | 175/432 |
| 5,544,713 | 8/1996 | Dennis | 175/434 |

FOREIGN PATENT DOCUMENTS

0462091A1 12/1991 European Pat. Off. .

*Primary Examiner*—William P. Neuder
*Attorney, Agent, or Firm*—James E. Bradley

[57] ABSTRACT

An earth-boring bit has a bit body and at least one cantilevered bearing shaft depending inwardly and downwardly from the bit body. A cutter is mounted for rotation on the bearing shaft and includes a plurality of cutting elements. At least one of the cutting elements has a generally cylindrical body formed of hard metal with a convex cutting end. A plurality of substantially linear, parallel lands are formed on the cutting end of the body. The lands have arcuate top surfaces and define grooves between the land having arcuate bottom surfaces. A layer of super-hard material is formed on the cutting end of the body and engages the lands and grooves formed thereon.

18 Claims, 2 Drawing Sheets

EARTH-BORING BIT WITH SUPER-HARD CUTTING ELEMENTS

BACKGROUND OF THE INVENTION

1.Field of the Invention

The present invention relates to improvement in the cutting structure of earth-boring bits of the rolling cutter variety. More specifically, the present invention relates to rolling cutter bits having improved super-hard or diamond cutting elements.

2.Background Information

The success of rotary drilling enabled the discovery of deep oil and gas reservoirs. The rotary rock bit was an important invention that made rotary drilling economical.

Only soft earthen formations could be penetrated commercially with the earlier drag bit, but the two-cone rock bit, invented by Howard R. Hughes, U.S. Pat. No. 930,759, drilled the hard caprock at the Spindletop Field near Beaumont, Tex., with relative ease. That venerable invention, within the first decade of this century, could drill a scant fraction of the depth and speed of the modern rotary rock bit. If the original Hughes bit drilled for hours, the modern bit drills for days. Modern bits sometimes drill for thousands of feet instead of merely a few feet. Many advances have contributed to the impressive improvement of rotary rock bits.

In drilling boreholes in earthen formations by the rotary method, rock bits fitted with one, two, or three rolling cutters are employed. The bit is secured to the lower end of a drillstring that is rotated from the surface or by downhole motors or turbines. The cutters mounted on the bit roll and slide upon the bottom of the borehole as the drillstring is rotated, thereby engaging and disintegrating the formation material to be removed. The roller cutters are provided with teeth or cutting elements that are forced to penetrate and gouge the bottom of the borehole by weight from the drillstring. The cuttings from the bottom and sidewalls of the borehole are washed away by drilling fluid that is pumped down from the surface through the hollow, rotating drillstring and are carried in suspension in the drilling fluid to the surface.

It has been a conventional practice for several years to provide diamond or super-hard cutting elements or inserts in earth-boring bits known as PDC, or fixed cutter bits. The excellent hardness, wear, and heat dissipation characteristics of diamond and other super-hard materials are of particular benefit in fixed cutter or drag bits, in which the primary cutting mechanism is scraping. Diamond cutting elements in fixed cutter or drag bits commonly comprise a disk or table of natural or polycrystalline diamond integrally formed on a cemented tungsten carbide or similar hard metal substrate in the form of a stud or cylindrical body that is subsequently brazed or mechanically fit on a bit body. One difficulty encountered with such arrangements is that the diamond table can be separated from its substrate when the interface between the diamond and the substrate is loaded in shear or tension.

One solution to the shearing-off problem has been to contour the interface surface with raised lands, wherein an interface is formed between the substrate and diamond layer that is resistant to shearing and tensile stresses. Examples of this are found in U.S. Pat. No. 5,109,737 to Bovenkerk, U.S. Pat. No. 5,120,327 to Dennis, U.S. Pat. No. 5,351,772 to Smith, and U.S. Pat. No. 5,355,969 to Hardy et al.

Implementation of diamond cutting elements as primary cutting structure in earth-boring bits of the rolling cutter variety has been somewhat less successful than with earth-boring bits of the fixed cutter variety. One reason for this lack of success is that the primary cutting elements of rolling cutter bits are subjected to more complex loadings, depending on their location on the cutters, making separation of the diamond tables from their substrates more likely. Moreover, because the loads encountered by the cutting elements of rolling cutter bits are typically much larger in magnitude than the loads sustained by the cutting elements of fixed cutter bits, stress concentrations caused by prior-art land and groove arrangements at the interface between the diamond and its substrate, such as shown by U.S. Pat. No. 5,379,854 to Dennis, can cause the diamond to crack or fracture.

One solution is found in U.S. Pat. Nos. 4,525,178; 4,504106; and 4,694,918 to Hall, which disclose cutting elements for a rolling cutter bit having the diamond and substrate formed integrally with a transition layer of a composite of diamond and carbide between the diamond layer and carbide layer. This transition layer is purported to reduce residual stresses between the diamond and carbide because the composite material reduces the differences in mechanical and thermal properties between the diamond and carbide materials. Another solution, disclosed in commonly assigned Pat. No. 5,119,714 to Scott, is to form a hard metal jacket around a diamond core. Unfortunately, these can be more difficult to manufacture than conventional flat PDC parts and are subject to costly and complex finishing operations.

A need exists, therefore, for diamond cutting elements or inserts for earth-boring bits of the rolling cutter variety that are sufficiently durable to withstand the rugged downhole environment and that are economical in manufacture.

SUMMARY OF THE INVENTION

It is a general object of the present invention to provide an earth-boring bit of the rolling cutter variety having improved, super-hard cutting elements.

This and other objects of the invention are achieved by providing an earth-boring bit having a bit body and at least one cantilevered bearing shaft depending inwardly and downwardly from the bit body. A cutter is mounted for rotation on the bearing shaft and includes a plurality of cutting elements. At least one of the cutting elements has a generally cylindrical body formed of hard metal with a convex cutting end. A plurality of substantially linear, parallel lands are formed on the convex cutting end of the body. The lands have flat top surfaces and define grooves between the lands having arcuate bottom surfaces. A layer of super-hard material is formed on the cutting end of the body and engages the lands and grooves formed thereon.

According to the preferred embodiment of the present invention, the cutting end is chisel-shaped and defines a pair of flanks converging to define a crest. A pair of ends connect the flanks. The lands and grooves are formed on the flanks substantially parallel to the crest and the layer of super-hard material covers the flanks, crest, and ends of the cutting end. The lands and grooves also may be provided on the ends.

According to the preferred embodiment of the present invention, the hard metal is cemented tungsten carbide and the super-hard material is polycrystalline diamond.

DESCRIPTION OF THE PREFERRED EMBODIMENT

Figure 1:
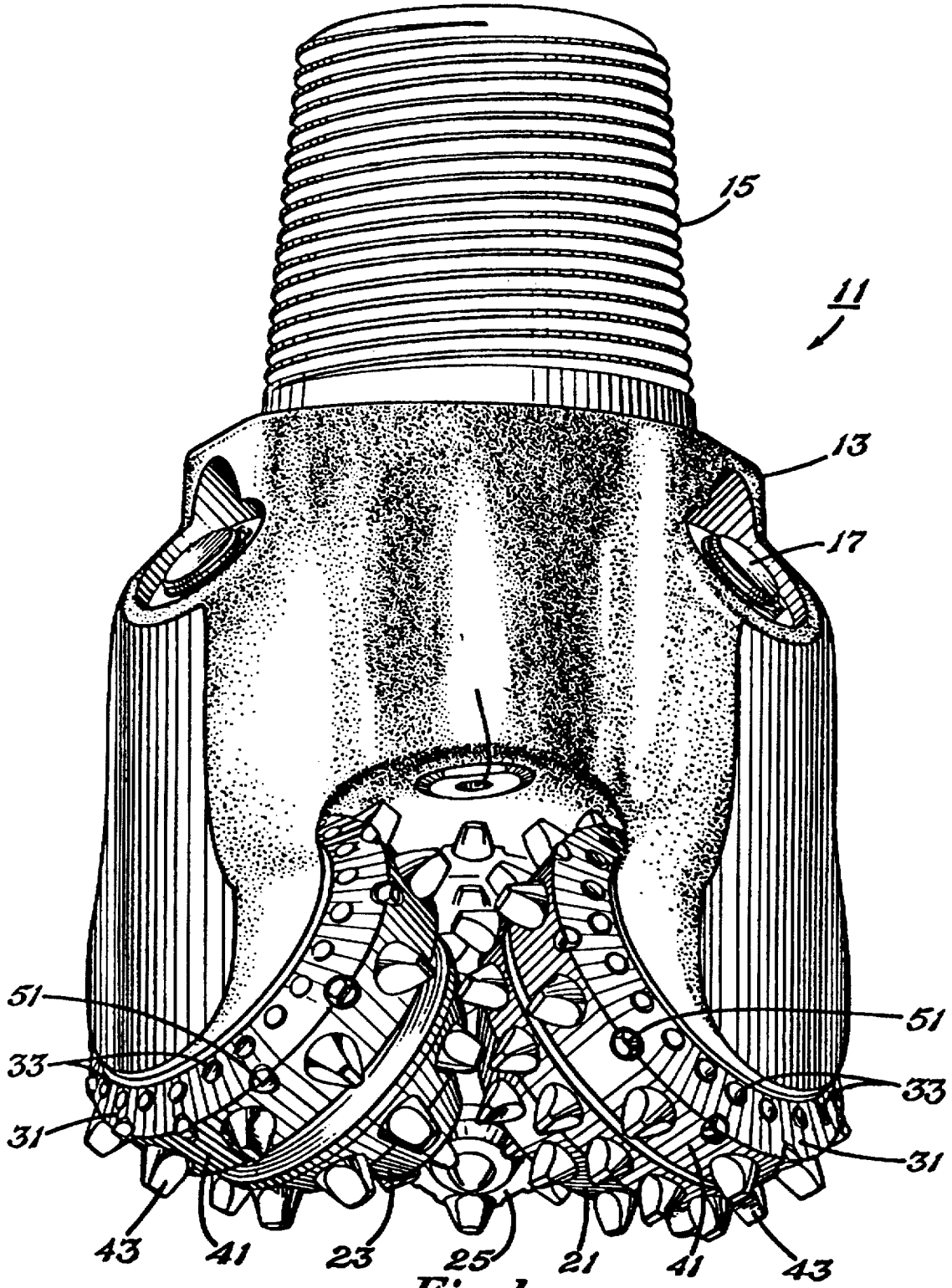
FIG. 1 is a perspective view of an earth-boring bit of the rolling cutter variety according to the present invention.

Referring now to the Figures and to particularly to FIG. 1, an earth-boring bit 11 according to the present invention is illustrated. Bit 11 includes a bit body 13, which is threaded at its upper extent 15 for connection into a drill string. Each leg or section of bit 11 is provided with a lubricant compensator 17. At least one nozzle 19 is provided in bit body 13 to spray drilling fluid from within the drillstring to cool and lubricate bit 11 during drilling operation. Three cutters 21, 23, 25 are rotatably secured to a bearing shaft associated with each leg of bit body 13.

Each cutter 21, 23, 25 has a cutter shell surface including a gage surface 31 and a heel surface 41. A plurality of cutting elements are arranged in generally circumferential rows on the cutter shell surface. Cutting elements preferably are secured in apertures in the cutters by interference fit and include gage cutting elements 33 on gage surfaces 31, heel cutting elements 43 on heel surfaces 41, and several inner rows of cutting elements. Gage trimmer or scraper elements 51 are provided generally at the intersection of gage 31 and heel 41 surfaces as disclosed in commonly assigned U.S. Pat. No. 5,351,768 and 5,479,997 to Scott et al.

Figure 2:
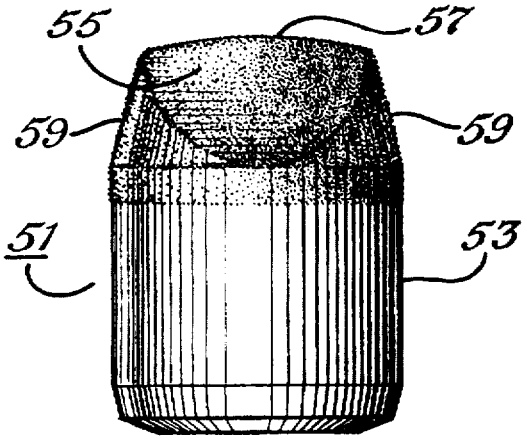
FIG. 2 is an elevation view of the improved cutting element according to the present invention.

FIG. 2 is an elevation view of a cutting element 51 according to the present invention. Although the cutting element or insert illustrated corresponds to a trimmer or scraper insert (51 in FIG. 1), the present invention pertains equally to heel inserts (43 in FIG. 1) and inner row inserts. Cutting element 51 comprises a generally cylindrical body 53 formed of hard metal, preferably cemented tungsten carbide. A convex, chisel-shaped cutting end of body 53 has a pair of flanks 55 converging at about 45° to define a crest 57. A pair of ends 59 connect flanks 55 and crest 57 to cylindrical body 53. The cutting end of element 51 is formed of a layer of super-hard material applied over flanks 55, crest 57, and ends 59 of body 53. Super-hard materials include natural diamond, polycrystalline diamond, cubic boron nitride, and other similar materials approaching diamond in hardness and having hardnesses upward of about 3500 to 5000 on the Knoop hardness scale.

Figure 3B:
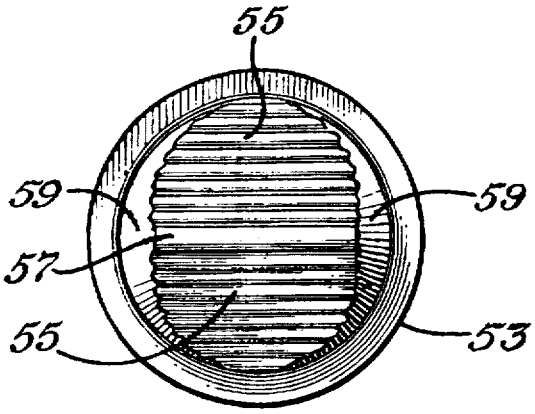
FIGS. 3A–3C are front elevation, plan, and side elevation views, respectively, of the body of the cutting element of FIG. 2.
Figure 3A:
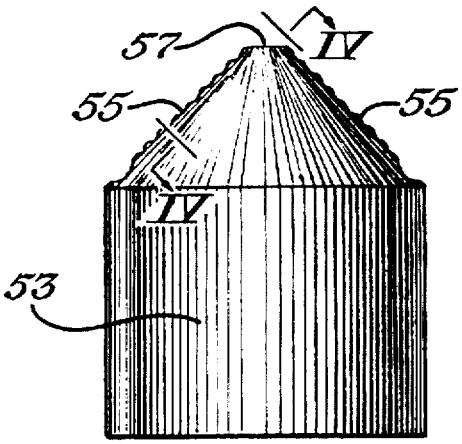
Figure 3C:
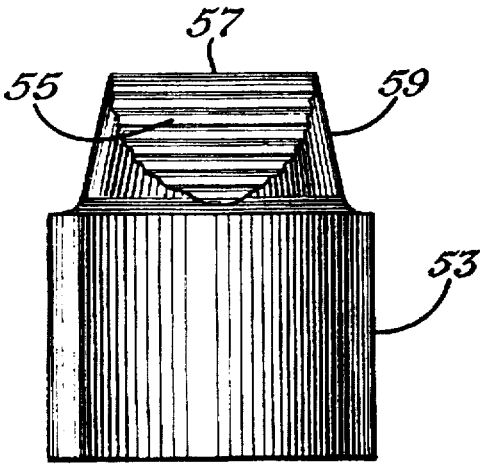

FIGS. 3A–3C are front elevation, plan, and side elevation views, respectively, of cylindrical body 53 prior to the formation of the layer of super-hard material on the cutting end. For ease of reference, the same numerals are used as are used in FIG. 2, although the super-hard material is not formed on the cutting end of body 53. The cutting end of body 53, comprising flanks 55, crests 57, and ends 59, is of a smaller major diameter than body 53 and defines a filleted shoulder to permit application of the layer of super-hard material to result in an element that is continuous and flush in transition from the super-hard material of the cutting end to the hard metal of the cylindrical portion of body 53. Flanks 55 of the cutting end are provided with a plurality of substantially linear, parallel lands (61 in FIG. 4) that define grooves (63 in FIG. 4) between the lands. After the layer of super-hard material is formed over flanks 55, crests 57, and ends 59 of the cutting end of body 53, the super-hard material engages lands 61 and grooves 63 to provide an interlocking interface between the hard metal and the super-hard material that is resistant to shear and tensile stresses acting between the super-hard material and hard metal.

Figure 4:
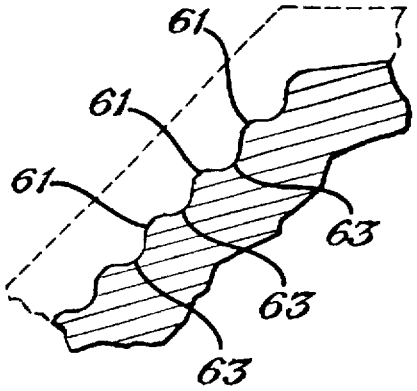
FIG. 4 is an enlarged view of a portion of the body of the cutting element of FIGS. 3A–3C.

FIG. 4 is an enlarged view of a portion of a flank (55 in FIGS. 3A–3C) of the cutting end of body 53. Lands 61 have flat or rectilinear top surfaces and grooves 63 have arcuate bottom surfaces. To avoid stress concentrations at the interface, the intersections of lands 61 and grooves 63 define oblique angles rather than right or acute angles. The bottoms of grooves 63 are generally circular radii. The top and bottom surfaces of lands 61 and grooves 63 are thus free of sharp corners and the like to reduce stress concentrations in the interface between the super-hard material (shown in phantom) and the hard metal body, thereby reducing the likelihood of cracking or fracturing of the super-hard material.

As shown in FIG. 4, lands 61 preferably are 0.008 inch wide and are spaced-apart 0.035 inch center-to-center. Grooves 63 are 0.007 inch deep and have a radius of 0.012 inch. The angle included between adjacent land 61 intersections with each groove 63 preferably is 90°, which permits lands 61 and grooves 63 to be formed integrally into the cutting end of body 53 by conventional powder metallurgy processing techniques, eliminating the need for machining or grinding operations. Further assisting the integral formation of grooves 63 is that the ascending (upwardly curving toward crest 57) portions of each groove are provided with a draft angle of 15° from vertical (all dimensions given are nominal).

Figure 5:
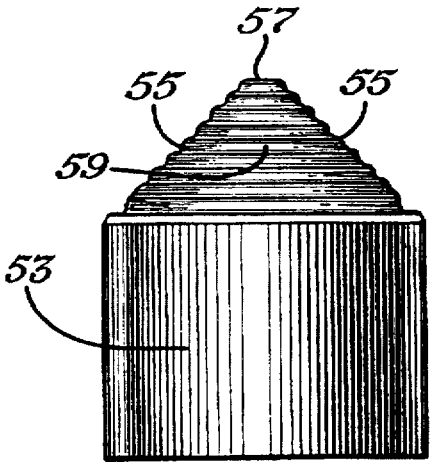
FIG. 5 is an elevation view, similar to FIG. 3A, of an alternative embodiment of the present invention.

FIG. 5 is an elevation view, similar to FIG. 3A, of an alternative embodiment of the present invention in which lands and grooves are formed in ends 59 as well as on flanks 55 of the cutting end of body 53. As with lands 61 and grooves 63 in FIG. 4, the lands and grooves are substantially linear (although curved along the contour of ends 59) and parallel to crest 57 and are formed to avoid stress concentrations in the layer of super-hard material.

Hard metal body 53 of cutting element 51 is formed using conventional powder metallurgy techniques, including hot isostatic pressing (HIP). The polycrystalline diamond super-hard layer is formed using high-pressure, high-temperature processes such as those disclosed in U.S. Pat. Nos. 3,745,623 and 3,913,280.

The earth-boring bit according to the present invention possesses a number of advantages. A principal advantage is that the bit is provided with super-hard cutting elements that can withstand the rigors of drilling with rolling cutter bits yet are economically manufactured.

The invention has been described with reference to a preferred embodiment thereof. It is thus not limited but is susceptible to variation and modification without departing from the scope and spirit of the invention.

We claim:

1. An earth-boring bit comprising:

a bit body;

at least one cantilevered bearing shaft depending inwardly and downwardly from the bit body;

a cutter mounted for rotation on the bearing shaft, the cutter including a plurality of cutting elements;

at least one of the cutting elements having:

a generally cylindrical body of hard metal, the body having a convex cutting end;

a plurality of lands formed on the cutting end of the body, the lands having flat top surfaces and defining grooves between the lands having concave arcuate bottom surfaces, intersections of the grooves and lands defining oblique angles; and a layer of super-hard material formed on the cutting end of the body and engaging the lands and grooves formed thereon.

2. The earth-boring bit according to claim 1 wherein the cutting end is chisel-shaped and defines a pair of flanks converging to define a crest, and a pair of ends connecting the flanks, the lands being formed on the flanks substantially parallel to the crest, and the layer of super-hard material covers the flanks, crest, and ends of the cutting end.

3. The earth-boring bit according to claim 1 wherein the hard metal is cemented tungsten carbide, and the super-hard material is polycrystalline diamond.

4. The earth-boring bit according to claim 1 wherein the lands and grooves are formed integrally with the hard metal body.

5. The earth-boring bit according to claim 1 wherein the lands are linear and parallel to one another.

6. An earth-boring bit comprising:

a bit body;

at least one cantilevered bearing shaft depending inwardly and downwardly from the bit body;

a cutter mounted for rotation on the bearing shaft, the cutter including a plurality of cutting elements;

at least one of the cutting elements having:

a generally cylindrical body of hard metal, the body having a convex cutting end with a major dimension less than the diameter of the element body;

a plurality of substantially linear, parallel lands formed on the cutting end of the element body, the lands having flat top surfaces and defining grooves between the lands and having concave arcuate bottom surfaces, intersections of the grooves and lands defining oblique angles; and a layer of super-hard material formed on the cutting end of the element body and engaging the lands and grooves formed thereon and extending flush with the diameter of the element body.

7. The earth-boring bit according to claim 6 wherein the cutting end is chisel-shaped and defines a pair of flanks converging to define a crest, and a pair of ends connecting the flanks, the land being formed on the flanks sustantially parallel to the crest, and the layer of super-hard material covers the flanks, crest, and ends of the cutting end.

8. The earth-boring bit according to claim 7 wherein the hard metal is cemented tungsten carbide, and the super-hard material is polycrystalline diamond.

9. The earth-boring bit according to claim 6 wherein the lands and grooves are formed integrally with the hard metal body.

10. An earth-boring bit comprising:

a bit body;

at least one cantilevered bearing shaft depending inwardly and downwardly from the bit body;

a cutter mounted for rotation on the bearing shaft, the cutter including a plurality of cutting elements;

at least one of the cutting elements having:

a generally cylindrical body of hard metal, the body having a chisel-shaped cutting end having a pair of flanks converging to define a crest, and a pair of ends connecting the flanks, the cutting end having a major dimension less than the diameter of the body, defining a shoulder at the intersection of the cutting end and element body;

a plurality of substantially linear, parallel lands formed on the flanks substantially parallel to the crest, the lands having flat top surfaces and defining grooves between the lands having concave arcuate bottom surfaces, intersections of the grooves and lands defining oblique angles; and a layer of super-hard material formed over the crest, flanks, and ends engaging the lands and grooves formed on the flanks, the layer of super-hard material being flush with the shoulder.

11. The earth-boring bit according to claim 10 wherein the lands and grooves are formed integrally with the hard metal body.

12. The earth-boring bit according to claim 10 wherein the hard metal is cemented tungsten carbide, and the super-hard material is polycrystalline diamond.

13. The earth-boring bit according to claim 10 wherein the ends are provided with lands defining grooves, the lands and grooves having arcuate top and bottom surfaces.

14. An earth-boring bit comprising:

a bit body;

at least one cantilevered bearing shaft depending inwardly and downwardly from the bit body;

a cutter mounted for rotation on the bearing shaft, the cutter including a plurality of cutting elements;

at least one of the cutting elements having:

a generally cylindrical body of hard metal, the body having a convex cutting end;

a plurality of substantially linear, parallel lands formed on the cutting end of the body, the lands having flat top surfaces and defining generally arcuate grooves between the lands, the grooves having concave arcuate bottom surfaces, intersections of the grooves and lands defining oblique angles; and a layer of super-hard material formed on the cutting end of the body and engaging the lands and grooves formed thereon.

15. The earth-boring bit according to claim 14 wherein the cutting end is chisel-shaped and defines a pair of flanks converging to define a crest, and a pair of ends connecting the flanks, the lands being formed on the flanks substantially parallel to the crest, and the layer of super-hard material covers the flanks, crest, and ends of the cutting end.

16. The earth-boring bit according to claim 14 wherein the hard metal is cemented tungsten carbide, and the super-hard material is polycrystalline diamond.

17. The earth-boring bit according to claim 14 wherein the lands and grooves are formed integrally with the hard metal body.

18. The earth-boring bit according to claim 14 wherein the lands and grooves are formed in the flanks and ends of the cutting end of the hard metal body.

* * * * *